US010319322B2

(12) United States Patent
Wang

(10) Patent No.: US 10,319,322 B2
(45) Date of Patent: Jun. 11, 2019

(54) GATE DRIVER, DISPLAY PANEL AND DISPLAY USE THE SAME

(71) Applicant: Shenzhen China Star Optoelectronics Technology Co., Ltd., Shenzhen, Guangdong (CN)

(72) Inventor: Zhao Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 142 days.

(21) Appl. No.: 15/308,892

(22) PCT Filed: Sep. 14, 2016

(86) PCT No.: PCT/CN2016/099043
§ 371 (c)(1),
(2) Date: Nov. 4, 2016

(87) PCT Pub. No.: WO2018/032568
PCT Pub. Date: Feb. 22, 2018

(65) Prior Publication Data

US 2018/0190229 A1 Jul. 5, 2018

(30) Foreign Application Priority Data

Aug. 17, 2016 (CN) ..... 2016 1 0683196

(51) Int. Cl.
*G09G 3/20* (2006.01)
*G09G 3/36* (2006.01)

(52) U.S. Cl.
CPC ..... *G09G 3/3677* (2013.01); *G09G 3/20* (2013.01); *G09G 2310/0267* (2013.01);
(Continued)

(58) Field of Classification Search
CPC ... G09G 2310/0237; G09G 2310/0264; G09G 2310/0286; G09G 2310/0289; G09G 2310/0291; G09G 2310/066; G09G 3/3677
See application file for complete search history.

(56) References Cited

U.S. PATENT DOCUMENTS 6,369,808 B1 * 4/2002 Kashiwada ..... G09G 3/3677 345/204
9,159,289 B2 * 10/2015 Han ..... G09G 3/3677
(Continued)

FOREIGN PATENT DOCUMENTS

CN 101520998 A 9/2009
CN 102136247 A 7/2011
(Continued)

*Primary Examiner* — Nelson M Rosario
*Assistant Examiner* — Scott Au
(74) *Attorney, Agent, or Firm* — Andrew C. Cheng

(57) ABSTRACT

The present invention providing a gate driver used in display panel, wherein comprises: a chamfering module is configured to receive gate turn-on voltage signals and square wave controlling signals, and chamfers the gate turn-on voltage signals in accordance with the square wave controlling signals to generate and output chamfered gate turn-on voltage signals; and a level shifting module is configured to receive the chamfered gate turn-on voltage signals, inputs voltage signals and gate cut-off voltage signals, and outputs the chamfered gate turn-on voltage signals or the gate cut-off voltage signals in accordance with a voltage value of the input voltage signal. By integrating a chamfering module and a digital adjustable resistance module into a gate driver, it is not necessary to provide a chamfering circuit on a CB of display panel, so as the CB can be miniaturized.

8 Claims, 4 Drawing Sheets

(52) U.S. Cl.
CPC ..... *G09G 2310/0286* (2013.01); *G09G 2310/0289* (2013.01); *G09G 2310/0291* (2013.01); *G09G 2310/066* (2013.01); *G09G 2320/0223* (2013.01)

(56) References Cited

U.S. PATENT DOCUMENTS

| | | | | |
|---|---|---|---|---|
| 2002/0093500 | A1 | 7/2002 | Kashiwada | |
| 2004/0239662 | A1* | 12/2004 | Hosokawa | G09G 3/3648 345/204 |
| 2005/0088391 | A1 | 4/2005 | Kim | |
| 2009/0102775 | A1* | 4/2009 | Ku | G09G 3/3648 345/92 |
| 2011/0169796 | A1* | 7/2011 | Guo | G09G 3/3677 345/208 |
| 2014/0340291 | A1* | 11/2014 | Wang | G09G 3/3696 345/87 |

FOREIGN PATENT DOCUMENTS

| | | | |
|---|---|---|---|
| CN | 102881272 | A | 1/2013 |
| CN | 104123922 | A | 10/2014 |
| CN | 105206248 | A | 12/2015 |
| CN | 105513552 | A | 4/2016 |
| CN | 105825814 | A | 8/2016 |

* cited by examiner

GATE DRIVER, DISPLAY PANEL AND DISPLAY USE THE SAME

FIELD OF THE INVENTION

The present invention relates to a technology of display, and more particularly, to a gate driver, a gate driver, a display panel and a display with a function of chamfering process.

DESCRIPTION OF PRIOR ART

In the conventional display panel, a single-side drive method and a bilateral driving method are used. For the single-side drive method, display driving signals are transmitted from one side of a display panel (i.e., the left side of the display panel.) Because of resistor-capacitor delay (RC delay) effect, it results in difference between displaying effect of the left side and the right of the display panel.

In order to improve the displaying effect of display panel, display driving signals are usually provided to a chamfering process of prior art, so as to resolve the problem that displaying is not uniform case by RC delay.

FIG. 1 is a circuit diagram of chamfering process of prior art. Referring FIG. 1, processes of the chamfering process of prior art will be described below.

As shown in FIG. 1, VGHF is a display driving signal received from a display driving signals transmitting unit; VGH is a display driving signal providing to a display penal; GVON is a square wave controlling signal received from a clock controller, a chamfering circuit is controlled by the square wave controlling signals, so as the VGHF is be pulled up to the voltage of the VGH or be pulled down, to facilitate the chamfering process to the VGHF.

Chamfering the display driving signals describe above can be processed by controlling resistance values of a resistor R to regulate chamfering speed and depth of the VGHF. The VGH is output via a gate driver of display panel, so as to turn on thin film transistors (TFT) to charge.

FIG. 2 is an oscillogram of the display driving signals output from the gate driver of prior art. Referring to FIG. 2, VGH is the display driving signal; CKV is a clock signal; STV is a starting signal; Gate1, Gate2, . . . , GateN are plurality (n) of the display driving signals (i.e., gate signals or scanning signals) output from the gate driver. Herebelow, assuming that the display panel has N scanning lines, so the gate driver outputs each display driving signal to a corresponding one of the scanning line.

When a rising edge of the starting signal STV appeared, the gate driver outputs a first chamfered square wave signal of VGH treated as the Gate1 in a first square wave signal period of the clock signal CKV; then, the gate driver outputs a second chamfered square wave signal of VGH treated as the Gate2 in a second square wave signal period of the clock signal CKV; By the same token, on the other hand, the gate driver outputs a Nth chamfered square wave signal of VGH treated as the GateN in a Nth square wave signal period of the clock signal CKV Each output of Gate1, Gate2, . . . , GateN is controlled by a level shifter of the gate driver. FIG. 3 is a circuit diagram of the level shifter of prior art. Referring to FIG. 3, the level shifter treats the input VGH or a VGL (gate cut-off voltage signal) as an output signal Output in accordance with an input signal Input. The output signals Output comprise Gate1, Gate2, . . . , GateN and a VGL output to scan lines FIG. 4 is an oscillogram of input and output of the level shifter of prior art. Referring to FIGS. 3 and 4, when value of voltage of the input signal Input is VDD (which is usually about 3.3V,) the output signal Output is one of the Gate1, Gate2, . . . , GateN (i.e., the level shifter outputs the VGH;) and when value of voltage of the input signal Input is VSS (which is usually about 0V,) the output signal Output is the VGL.

However, in the current display panel design, it is difficult to design miniaturized products because of designing a chamfering circuit into a control board (CB) of display panel will cause the area of CB increased. Moreover, because the entire display panel shares a common chamfering circuit, when chamfering waveforms of optimal VGH in each partition are different, it cannot meet the requirements of different partitions, so as to exist a design limitation.

SUMMARY OF THE INVENTION

In order to solve deficiencies of prior art, the purpose of the present invention is to provide a gate driver, a gate driver, a display panel and a display with a function of chamfering process.

According to the present invention, on one hand, providing a gate driver used in display panel, wherein comprises: a chamfering module is configured to receive gate turn-on voltage signals and square wave controlling signals, and chamfers the gate turn-on voltage signals in accordance with the square wave controlling signals to generate and output chamfered gate turn-on voltage signals; and a level shifting module is configured to receive the chamfered gate turn-on voltage signals, inputs voltage signals and gate cut-off voltage signals, and outputs the chamfered gate turn-on voltage signals or the gate cut-off voltage signals in accordance with a voltage value of the input voltage signal.

Further, the input voltage signals are square wave voltage signals, when the input voltage signal has a first voltage value, the level shifting module outputs the chamfered gate turn-on voltage signals; and when the input voltage signal has a second voltage value, the level shifting module outputs the gate cut-off voltage signals, and wherein the first voltage value is large than the second voltage value.

Further, the square wave controlling signal controls the chamfering module which in turn controls the chamfering width of the gate turn-on voltage signal.

Further, the gate driver further comprises: a digital adjustable resistance module is configured to connect to a resistance port of the chamfering module, and the digital adjustable resistance module regulates the chamfering module which in turn controls the chamfering speed and depth of the gate turn-on voltage signals by regulating resistance values of a chamfering resistance.

Further, the digital adjustable resistance module is further configured to receive digital signals of inter-integrated circuit (I2C) and regulate the resistance values of the chamfering resistance in accordance with the digital signals of I2C.

Further, the chamfering module comprises: a first metal-oxide-semiconductor field effect transistor (MOS transistor) and a second MOS transistor; a source of the first MOS transistor is used to receive the gate turn-on voltage signals, both a drain of the first MOS transistor and a source of the second MOS transistor are connected to the level shifting module, both gates of the first and second MOS transistors are used to receive the square wave controlling signals, a drain of the second MOS transistor is the resistance port.

Further, when the first MOS transistor is cut-off and the second MOS transistor is turn-on, the gate turn-on voltage signal is discharged through the digital adjustable resistance module; and when the first MOS transistor is turn-on and the second MOS transistor is cut-off, the gate turn-on voltage signal is pulled up to the initial voltage, so as to achieve chamfering process to gate turn-on voltage signals.

Further, the gate driver further comprises: a buffer amplifier module is configured to amplify the chamfered gate turn-on voltage signals or the gate cut-off voltage signals output from the level shifting module, and outputs an amplified chamfered gate turn-on voltage signal or an amplified gate cut-off voltage signal.

According to the present invention, on the other hand, providing a display panel which comprises a gate driver described above.

According to the present invention, further on the other hand, providing a display which comprises a display panel described above.

The present invention can be concluded with the following advantages, by integrating a chamfering module and a digital adjustable resistance module into a gate driver, it is not necessary to provide a chamfering circuit on a CB of display panel, so as the CB can be miniaturized. In addition, when the display panel has a plurality of gate drivers, because each gate driver has the function of chamfering process, it is possible to achieve chamfered waveform of a partition corresponding to each of the gate driver can be controlled independently, and optimize the displaying effect.

BRIEF DESCRIPTION OF DRAWINGS

Technical implementation will be described below clearly and fully by combining with drawings made in accordance with an embodiment in the present invention.

DESCRIPTION OF PREFERRED EMBODIMENT

Technical implementation will be described below clearly and fully by combining with drawings made in accordance with an embodiment in the present invention. Obviously, the described embodiments are merely part of embodiment of the present invention, not at all. Based on the embodiments of the present invention, on the premise of embodiments in the absence of creative work, all other embodiments are in the scope of protection in the present invention.

Figure 5:
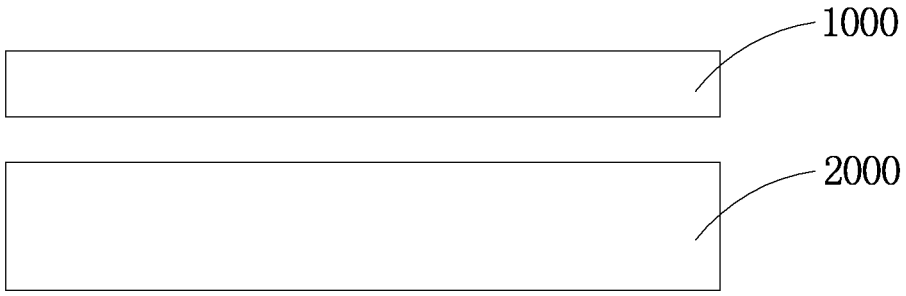
FIG. 5 is an illustrational view of a display in accordance with the embodiment of the present invention.

FIG. 5 is an illustrational view of a display in accordance with the embodiment of the present invention. Herebelow, a liquid crystal display (LCD) is used as one example for the display, but it shall not be construed as a limitation to the present invention. For example, the display may be an organic light emitting display (OLED.)

Referring to FIG. 5, the display according to the present invention which comprises: a display panel 1000 and a backlight module 2000. The backlight module 2000 provides a uniform light source to the display panel 1000 to display images. Because the display of the embodiment is a LCD, so the display panel 1000 is a LCD panel. It should be noticed that when the display of the embodiment is an OLED, the display panel 1000 is an OLED panel. The display panel 1000 will be described below clearly and fully.

Figure 6:
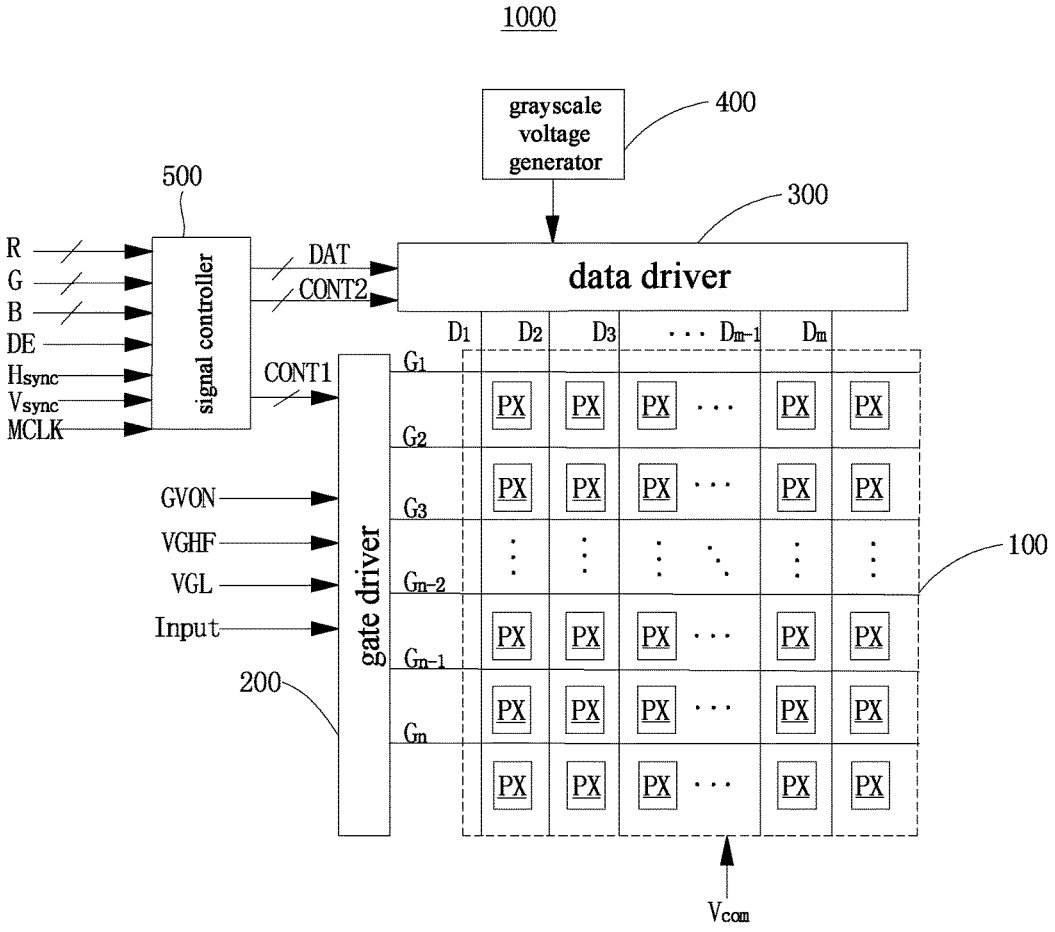
FIG. 6 is a block diagram of a liquid crystal display panel in accordance with the embodiment of the present invention.

FIG. 6 is a block diagram of a LCD panel in accordance with the embodiment of the present invention.

Referring to FIG. 6, the display panel 1000 according to the present invention which comprises: a LCD panel component 100; a gate driver 200 and a data driver 300, both are connected to the LCD panel component 100; a grayscale voltage generator 400, which is connected to the data driver 300 and a signal controller 500, which is used to control the LCD panel component 100, the gate driver 200, the data driver 300 and the grayscale voltage generator 400.

The LCD panel component 100 comprises a plurality of display signal lines and a plurality of pixels PX arranged in an array and connected to the display signal lines. The LCD panel component 100 can comprise: a lower display panel and an upper display panel opposite to each other, both are not shown in figure, and a liquid crystal layer is inserted between the lower display panel and the upper display panel, which is not shown in figure.

Display data lines can be arranged on the lower display panel, which can comprise a plurality of gate lines $G_1$ to $G_n$ for transmitting gate signals (i.e., data voltages) and a plurality of data lines $D_1$ to $D_m$ for transmitting data signals. The gate lines $G_1$ to $G_n$ are arranged extending to the row direction, and which are substantially parallel to each other. The data lines $D_1$ to $D_m$ are arranged extending to the column direction, and which are substantially parallel to each other.

Each pixel PX comprises: a switching device is connected to the corresponding gate lines and data lines; and a liquid crystal capacitor is connected to the switching device. If necessary, each color pixel PX can also comprise a storage capacitor connected to the liquid crystal capacitor in parallel.

Each switching device of pixel PX is a three-terminal device, therefore it has a controlling terminal connected to the corresponding gate line, an input connected to the corresponding data line and an output connected to the corresponding liquid crystal capacitor.

The gate driver 200 is connected to the gate lines $G_1$ to $G_n$, and supplies gate signals to the gate lines $G_1$ to $G_n$. Referring to FIG. 6, arranging the gate driver 200 on one side of the LCD panel component 100, and all the gate lines $G_1$ to $G_n$ are connected to the gate driver 200. However, but it shall not be construed as a limitation to the present invention, i.e., it can arrange two gate drivers on opposite sides of the LCD panel component 100 respectively, and one half of the gate lines $G_1$ to $G_n$ are connected to one of the two gate drivers, and the other half of the gate lines $G_1$ to $G_n$ are connected to the other.

The grayscale voltage generator 400 generates grayscale voltages which are closely related to the transmittance of the pixel PX. The grayscale voltage is supplied to each pixel PX, and the grayscale voltage has a positive value or a negative value in accordance with a common voltage Vcom.

The data driver 300 is connected to the data lines $D_1$ to $D_m$ of the LCD panel component 100, and the grayscale voltages generated from the grayscale voltage generator 400 treated as data voltages supplied to the pixel PX. If the grayscale voltage generator 400 does not supply all of the grayscale voltages but only the reference grayscale voltage, the reference grayscale voltage is distributed to generate various grayscale voltages, and the data driver 300 can choose one of them to be treated as the data voltage.

The signal controller 500 controls to operate the gate driver 200 and the data driver 300.

The signal controller 500 receives input image signals from an external graphics controller (which is not shown in figure) and a plurality of input controlling signals used to control the input image signals to display, such as vertical sync signals Vsync, horizontal sync signals Hsync, master clock signals MCLK, and data enable signals DE. The signal controller 500 processes the input image signals (R, G and B) appropriately in accordance with the controlling signals, so as to generate image data DAT which are meet to operating conditions of the LCD panel component 100. Then the signal controller 500 generates gate controlling signals CONT1 and data controlling signals CONT2, and transmits the gate controlling signals CONT1 to the gate driver 200, and transmits the data controlling signals CONT2 and the image data DAT to the data driver 300.

The gate control signal CONT1 may comprise: a scan starting signal STV for operating the gate driver 200, i.e., a scanning operation; and at least one of clock signal for controlling when to output the gate signals. The gate control signals CONT1 may also comprise outputting an enable signal OE for regulating duration of the gate signals. The clock signal may also be used for a selecting signal SE.

The data controlling signal CONT2 may comprise: a horizontal sync starting signal STH for indicating transmission the image data DAT; a load signal LOAD for requesting to supply data voltages corresponding to the image data DAT to the data lines $D_1$ to $D_m$; and a data clock signal HCLK. The data controlling signal CONT2 may also comprise an inverted signal RVS for inverting the polarity of the data voltages with respect to common voltages Vcom.

The data driver 300 receives image data DAT from the signal controller 500 in response to the data controlling signal CONT2, and converts the image data DAT to data voltages by selecting a grayscale voltage corresponding to the image data DAT from a plurality of grayscale voltages which are generated from the grayscale voltage generator 600. Then the data driver 300 supplies data voltages to the data lines $D_1$ to $D_m$.

The gate driver 200 supplies the gate signals to the gate lines $G_1$ to $G_n$ to turn-on or cut-off the switching devices connected to the gate lines $G_1$ to $G_n$ in response to the gate controlling signal CONT1. When the switching device connected to the gate lines $G_1$ to $G_n$ is turn-on, the data voltages supplied to the data lines $D_1$ to $D_m$ are transmitted to each pixel PX via the turned-on switching device.

The difference between each the pixel PX and the common voltage Vcom can be interpreted as the difference between the voltages applied to the liquid crystal capacitor of each pixel PX. The arrangement of the liquid crystal molecules varies depending on magnitude of pixel grayscale voltages, because of the polarity of light transmitted through a liquid crystal layer can also vary, resulting in the changes of the transmittance of the liquid crystal layer.

In the embodiment of the present invention, the gate signals applied from the gate driver 200 to the gate lines $G_1$ to $G_n$ comprises chamfered gate turn-on voltage signals and gate cut-off voltage signals. Elaboration will be given herebelow in view of how the gate driver 200 generates and outputs the chamfered gate turn-on voltage signals and gate cut-off voltage signals.

Figure 7:
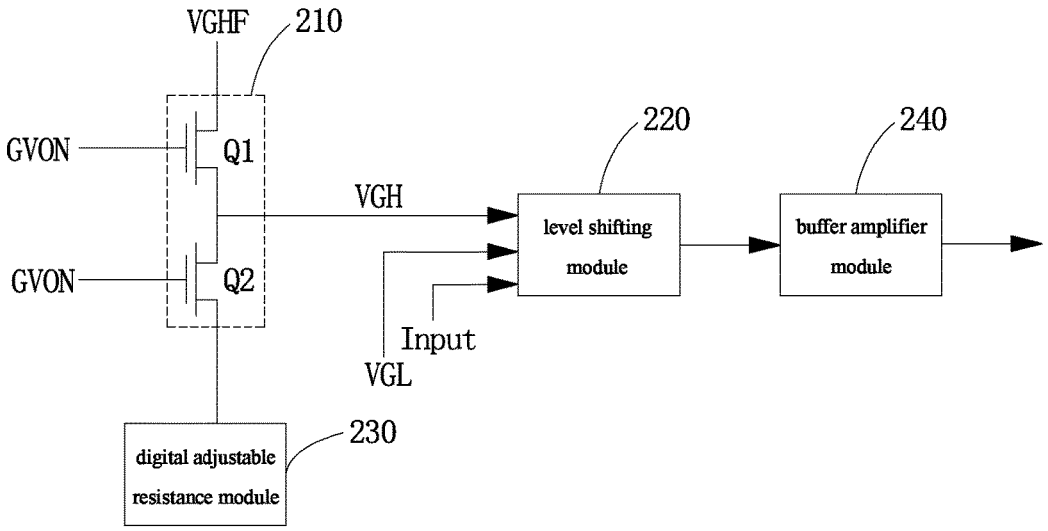
FIG. 7 is a block diagram of a gate driver in accordance with the embodiment of the present invention.

FIG. 7 is a block diagram of a gate driver in accordance with the embodiment of the present invention.

Referring to FIG. 7, the gate driver 200 according to the present invention which comprises: a chamfering module 210, a level shifting module 220, a digital adjustable resistance module 230 and a buffer amplifier module 240.

The chamfering module 210 is configured to receive gate turn-on voltage signals VGHF and square wave controlling signals GVON from an external source, and chamfers the gate turn-on voltage signals VGHF in accordance with the square wave controlling signals GVON to generate and output chamfered gate turn-on voltage signals VGH. Herebelow, the gate-on voltage signal VGHF is a voltage signal with a constant voltage value (i.e., an initial voltage value.)

The high level duration of the square wave controlling signal GVON can controls the chamfering module 210 which in turn controls the chamfering time of the gate turn-on voltage signal VGHF, so as to control the chamfering module 210 which in turn controls the chamfering width of the gate turn-on voltage signal VGHF.

Figure 1:
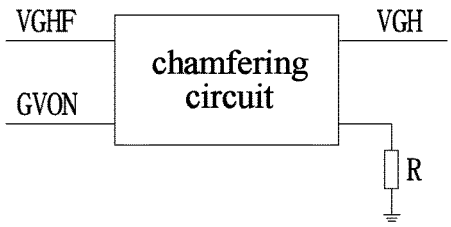
Figure 1 (Prior Art)
FIG. 1 is a circuit diagram of chamfering process of prior art.
Figure 2:
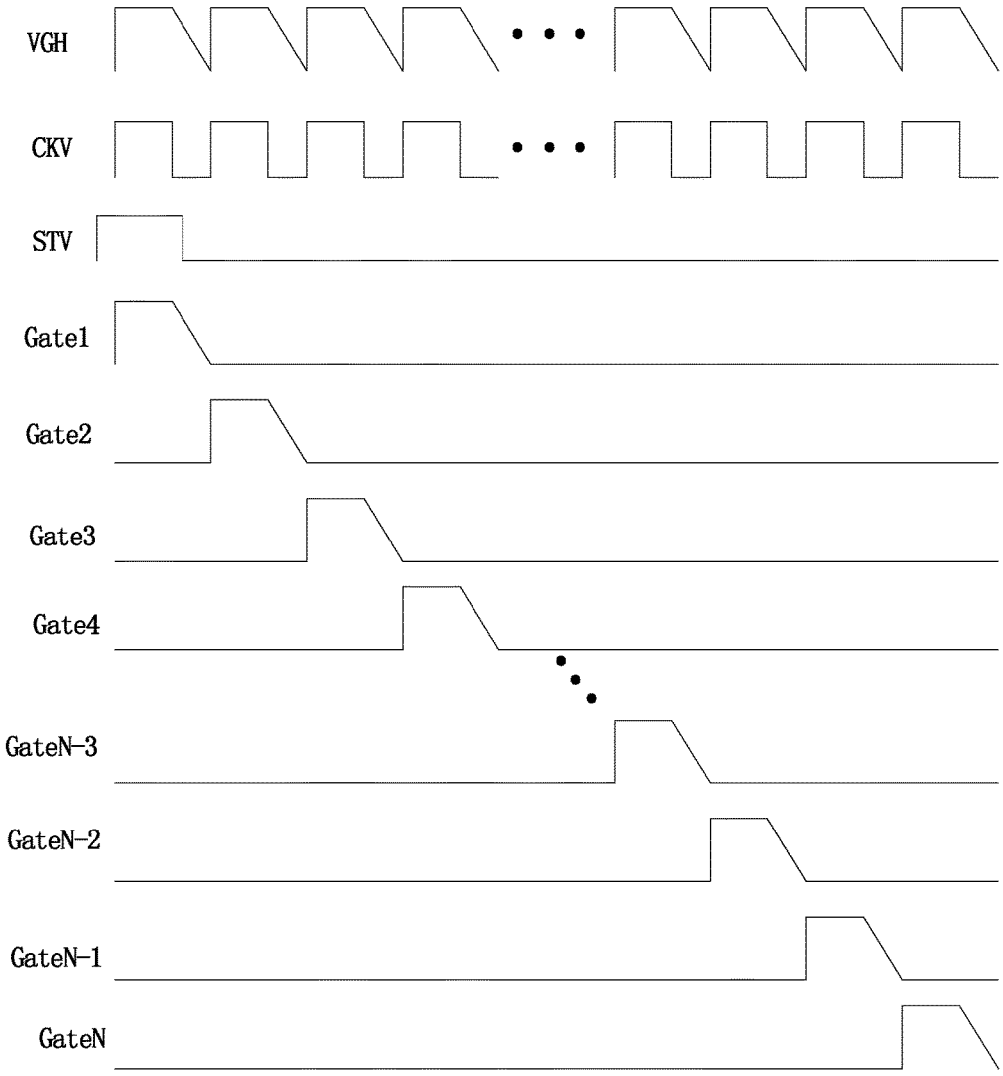
Figure 2 (Prior Art)
FIG. 2 is an oscillogram of a display driving signals output from the gate driver of prior art.
Figure 3:
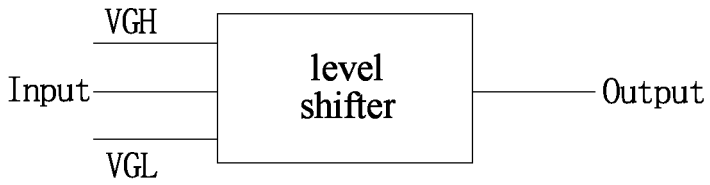
Figure 3 (Prior Art)
FIG. 3 is a circuit diagram of the level shifter of prior art.

The level shifting module 220 is configured to receive the chamfered gate turn-on voltage signals VGH, inputs voltage signals Input and gate cut-off voltage signals VGL, and outputs the chamfered gate turn-on voltage signals VGH or the gate cut-off voltage signals VGL in accordance with a voltage value of the input voltage signal Input. Herebelow, referring to FIGS. 3 and 4, The level shifting module 220 outputs each chamfered square wave signal of the chamfered gate turn-on voltage signals VGH sequentially in accordance with the input voltage signal Input and the gate controlling signal CONT1, so as to supply a plurality (n) of chamfered square wave signals to the corresponding gate lines $G_1$ to $G_n$.

Figure 4:
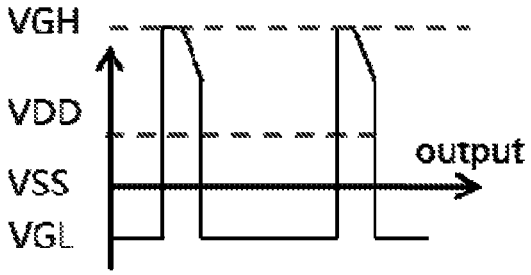
Figure 4 (Prior Art)
FIG. 4 is an oscillogram of input and output of the level shifter of prior art.

Herebelow, the input voltage signals Input are square wave voltage signals, when the input voltage signal Input has a voltage value VDD as shown in FIG. 4 (assume the voltage value is a first voltage value,) the level shifting module 220 outputs the chamfered gate turn-on voltage signals VGH (or one of the chamfered square wave signal the chamfered gate turn-on voltage signals VGH;) and when the input voltage signal Input has a voltage value VSS as shown in FIG. 4 (assume the voltage value is a second voltage value,) the level shifting module 220 outputs the gate cut-off voltage signals VGL.

The digital adjustable resistance module 230 is configured to connect to a resistance port of the chamfering module 210, and the digital adjustable resistance module 230 regulates the chamfering module 210 which in turn controls the chamfering speed and depth of the gate turn-on voltage signals VGHF by regulating resistance values of a chamfering resistance. Details will be described below. Further, the digital adjustable resistance module 230 is configured to receive digital signals of I2C and regulate the resistance values of the chamfering resistance in accordance with the digital signals of I2C.

The buffer amplifier module 240 is configured to amplify the chamfered gate turn-on voltage signals VGH or the gate cut-off voltage signals VGL output from the level shifting module 220, and outputs an amplified chamfered gate turn-on voltage signal VGH or an amplified gate cut-off voltage signal VGL. Herebelow, if the output of the level shifting module 220 drives to the gate lines $G_1$ to $G_n$ directly, its driving capability may be insufficient, so it needs more buffer amplifier modules 240 to increase the driving capability, e.g., in another embodiment of the present invention, the buffer amplifier modules 240 may not be presented.

Furthermore, each of the modules in the gate driver in accordance with in the embodiment of the present invention may be achieved as a hardware component. Skilled in the arts can achieve each of the module according to the process of each of the module by such as field-programmable gate array (FPGA) or application-specific integrated circuit (ASIC.)

Referring to FIG. 7 further, the chamfering module 210 comprises: a first MOS transistor Q1 and a second MOS transistor Q2; a source of the first MOS transistor Q1 is used to receive the gate turn-on voltage signals VGHF, both a drain of the first MOS transistor Q1 and a source of the second MOS transistor Q2 are connected to the level shifting module 220 to output the chamfered gate turn-on voltage signals VGH to the level shifting module 220, both gates of the first and second MOS transistors Q1 and Q2 are used to receive the square wave controlling signals GVON, a drain of the second MOS transistor Q2 is the resistance port, e.g., the drain of the second MOS transistor Q2 is connected to the digital adjustable resistance module 230.

The square wave controlling signals GVON control the first and second MOS transistors Q1 and Q2 to turn-on or cut-off. When the first MOS transistor Q1 is cut-off and the second MOS transistor Q2 is turn-on, the gate turn-on voltage signal VGHF is discharged through the digital adjustable resistance module 230; and when the first MOS transistor Q1 is turn-on and the second MOS transistor Q2 is cut-off, the gate turn-on voltage signal VGHF is pulled up to the initial voltage, so as to facilitate the chamfering process to the gate turn-on voltage signals VGHF.

As described above, the digital adjustable resistance module 230 is configured to regulate the chamfering module 210 which in turn controls the chamfering speed and depth of the gate turn-on voltage signals VGHF by regulating resistance values of a chamfering resistance. Specifically, when the digital adjustable resistance module 230 regulates the resistance value of itself (i.e., the resistance value of the chamfering resistance) to reduce, discharge voltage for discharging of the gate turn-on voltage signal VGHF by the digital adjustable resistance module 230 is increased and discharge rate is accelerated, the chamfering depth of the gate-on voltage signal VGHF is increased and the chamfering speed is accelerated; and when the digital adjustable resistance module 230 regulates the resistance value of itself (i.e., the resistance value of the chamfering resistance) to increase, discharge voltage for discharging of the gate turn-on voltage signal VGHF by the digital adjustable resistance module 230 is reduced and discharge rate is decelerated, the chamfering depth of the gate-on voltage signal VGHF is reduced and the chamfering speed is decelerated.

In summary, because of integrating a chamfering module and a digital adjustable resistance module into a gate driver, it is not necessary to provide a chamfering circuit on a CB of display panel, so as the CB can be miniaturized. In addition, when the display panel has a plurality of gate drivers, because each gate driver has the function of chamfering process, it is possible to achieve chamfered waveform of a partition corresponding to each of the gate driver can be controlled independently, and optimize the displaying effect.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

The invention claimed is:

1. A gate driver used in display panel, comprising:

a chamfering module receiving gate turn-on voltage signals and square wave controlling signals, and chamfering the gate turn-on voltage signals in accordance with the square wave controlling signals to generate and output chamfered gate turn-on voltage signals; and a level shifting module receiving the chamfered gate turn-on voltage signals, inputting voltage signals and gate cut-off voltage signals, and outputting the chamfered gate turn-on voltage signals or the gate cut-off voltage signals in accordance with a voltage value of the input voltage signal;

wherein the gate driver further comprises a digital adjustable resistance module connecting to a resistance port of the chamfering module, and the digital adjustable resistance module regulating the chamfering module which in turn controlling the chamfering speed and depth of the gate turn-on voltage signals by regulating resistance values of a chamfering resistance; and wherein the chamfering module comprises a first metal-oxide-semiconductor field effect transistor and a second metal-oxide-semiconductor field effect transistor; and a source of the first metal-oxide-semiconductor field effect transistor used to receive the gate turn-on voltage signals, both a drain of the first metal-oxide-semiconductor field effect transistor and a source of the second metal-oxide-semiconductor field effect transistor connected to the level shifting module, both gates of the first and second metal-oxide-semiconductor field effect transistors used to receive the square wave controlling signals, a drain of the second metal-oxide-semiconductor field effect transistor being the resistance port.

2. The gate driver as recited in claim 1, wherein the input voltage signals are square wave voltage signals, when the input voltage signal has a first voltage value, the level shifting module outputs the chamfered gate turn-on voltage signals, and when the input voltage signal has a second voltage value, the level shifting module outputs the gate cut-off voltage signals, and wherein the first voltage value is large than the second voltage value.

3. The gate driver as recited in claim 1, wherein the square wave controlling signal controls the chamfering module which in turn controls the chamfering width of the gate turn-on voltage signal.

4. The gate driver as recited in claim 1, wherein the digital adjustable resistance module receives digital signals of inter-integrated circuit and regulate the resistance values of the chamfering resistance in accordance with the digital signals of inter-integrated circuit.

5. The gate driver as recited in claim 1, wherein when the first metal-oxide-semiconductor field effect transistor is cut-off and the second metal-oxide-semiconductor field effect transistor is turn-on, the gate turn-on voltage signal is discharged through the digital adjustable resistance module, and when the first metal-oxide-semiconductor field effect transistor is turn-on and the second metal-oxide-semiconductor field effect transistor is cut-off, the gate turn-on voltage signal is pulled up to the initial voltage, so as to achieve chamfering process to gate turn-on voltage signals.

6. The gate driver as recited in claim 1, wherein the gate driver further comprises a buffer amplifier module amplifies the chamfered gate turn-on voltage signals or the gate cut-off voltage signals output from the level shifting module, and outputting an amplified chamfered gate turn-on voltage signal or an amplified gate cut-off voltage signal.

7. A display panel, which comprises a gate driver, wherein the gate driver comprises:

a chamfering module receiving gate turn-on voltage signals and square wave controlling signals, and chamfering the gate turn-on voltage signals in accordance with the square wave controlling signals to generate and output chamfered gate turn-on voltage signals; and a level shifting module receiving the chamfered gate turn-on voltage signals, inputting voltage signals and gate cut-off voltage signals, and outputting the chamfered gate turn-on voltage signals or the gate cut-off voltage signals in accordance with a voltage value of the input voltage signal;

wherein the gate driver further comprises a digital adjustable resistance module connecting to a resistance port of the chamfering module, and the digital adjustable resistance module regulating the chamfering module which in turn controlling the chamfering speed and depth of the gate turn-on voltage signals by regulating resistance values of a chamfering resistance; and wherein the chamfering module comprises: a first metal-oxide-semiconductor field effect transistor and a second metal-oxide-semiconductor field effect transistor; and a source of the first metal-oxide-semiconductor field effect transistor used to receive the gate turn-on voltage signals, both a drain of the first metal-oxide-semiconductor field effect transistor and a source of the second metal-oxide-semiconductor field effect transistor connected to the level shifting module, both gates of the first and second metal-oxide-semiconductor field effect transistors used to receive the square wave controlling signals, a drain of the second metal-oxide-semiconductor field effect transistor being the resistance port.

8. A display, which comprises a display panel with a gate driver, wherein the gate driver comprises:

a chamfering module receiving gate turn-on voltage signals and square wave controlling signals, and chamfering the gate turn-on voltage signals in accordance with the square wave controlling signals to generate and output chamfered gate turn-on voltage signals; and a level shifting module receiving the chamfered gate turn-on voltage signals, inputting voltage signals and gate cut-off voltage signals, and outputting the chamfered gate turn-on voltage signals or the gate cut-off voltage signals in accordance with a voltage value of the input voltage signal;

wherein the gate driver further comprises a digital adjustable resistance module connecting to a resistance port of the chamfering module, and the digital adjustable resistance module regulating the chamfering module which in turn controlling the chamfering speed and depth of the gate turn-on voltage signals by regulating resistance values of a chamfering resistance; and wherein the chamfering module comprises a first metal-oxide-semiconductor field effect transistor and a second metal-oxide-semiconductor field effect transistor; and a source of the first metal-oxide-semiconductor field effect transistor used to receive the gate turn-on voltage signals, both a drain of the first metal-oxide-semiconductor field effect transistor and a source of the second metal-oxide-semiconductor field effect transistor connected to the level shifting module, both gates of the first and second metal-oxide-semiconductor field effect transistors used to receive the square wave controlling signals, a drain of the second metal-oxide-semiconductor field effect transistor being the resistance port.

* * * * *